US005802636A

United States Patent [19]

Corbin et al.

[11] Patent Number: 5,802,636

[45] Date of Patent: Sep. 8, 1998

[54] INTEGRATED SIDERAIL AND ACCESSORY RAIL FOR A BED

[75] Inventors: Scott M. Corbin, Sunman, Ind.; Jeffrey A. Moster, Cincinnati, Ohio; Robert W. Wilson, Batesville; John D. Miller, Brookville, both of Ind.

[73] Assignee: Hill-Rom, Inc., Batesville, Ind.

[21] Appl. No.: 747,318

[22] Filed: Nov. 12, 1996

[51] Int. Cl.[6] ..... A47C 21/08

[52] U.S. Cl. ..... 5/425; 5/430; 5/503.1; 5/663

[58] Field of Search ..... 5/430, 428, 425, 5/503.1, 507.1, 658, 663, 621, 622, 623, 624; 248/345.1

[56] References Cited

U.S. PATENT DOCUMENTS

| | | | |
|---|---|---|---|
| 2,644,961 | 7/1953 | Hillenbrand et al. . | |
| 2,722,017 | 11/1955 | Burst et al. . | |
| 3,009,676 | 11/1961 | Buchwald | 5/503.1 |
| 3,195,153 | 7/1965 | Armstrong | 5/430 |
| 3,506,989 | 4/1970 | Ross et al. . | |
| 3,585,659 | 6/1971 | Burst et al. . | |
| 4,629,242 | 12/1986 | Schrager . | |
| 4,839,933 | 6/1989 | Plewright | 5/430 |
| 4,987,623 | 1/1991 | Stryker et al. . | |
| 5,129,117 | 7/1992 | Celestina et al. . | |
| 5,197,156 | 3/1993 | Stryker | 5/430 |
| 5,319,816 | 6/1994 | Ruehl . | |

*Primary Examiner*—Flemming Saether
*Attorney, Agent, or Firm*—Barnes & Thornburg

[57] ABSTRACT

A rail apparatus is configured to be mounted to a frame of a bed. The apparatus includes a siderail, a support having a first end pivotably coupled to the siderail and a second end, and a bottom mounting pivotably coupled to the second end of the support. The bottom mounting including at least one mounting bracket for coupling the bottom mounting to the frame of the bed, and an accessory rail configured to permit mounting of accessory items on the rail apparatus.

21 Claims, 2 Drawing Sheets

INTEGRATED SIDERAIL AND ACCESSORY RAIL FOR A BED

BACKGROUND AND SUMMARY OF THE INVENTION

The present invention relates to an improved accessory attachment apparatus for use in a hospital room, nursing home, or other medical facility. More particularly, the present invention relates to an improved accessory bar or rail configured to be mounted on a bed to permit attachment of desired accessory items to the rail.

It is known to use accessory rails mounted on a wall of a hospital room or to a frame of a hospital bed for supporting various accessory items. Accessory items are typically mounted to these accessory rails using known clamps. In addition, items can be hung from the accessory rails.

Problems are associated with the use of such conventional accessory rails, especially when the rails are mounted on a hospital bed. First, the accessory rails may block the use of other items, such as siderails or barriers used to help keep a patient in the bed. Second, such known accessory rails attached to the bed frame can be difficult to clean. Fasteners that are used to secure the accessory rails to the bed provide areas that can collect dirt or other contaminants.

Therefore, it is desirable to provide an accessory rail on the bed which does not interfere with any moving components of the bed or with operation of the siderail of the bed. In addition, the accessory rail should be easy to clean for use in a medical environment.

The present invention provides such an accessory rail integral with the siderail barrier of the bed. The improved structure of the present invention permits the use of any length siderail with an accessory rail. The accessory rail is incorporated into a bottom or lower weldment of the siderail assembly. The accessory rail of the present invention also acts as a perimeter bumper and provides a near zero transfer gap to facilitate moving a patient from the bed.

Since the accessory rail of the present invention is part of the siderail barrier assembly, it does not interfere with operation of any moving components of the bed or siderail. The entire accessory rail is preferably coated with a nylon based finish to provide a scratch resistant outer surface. The color of the finish can be selected to match the bed frame color so that the accessory rail is aesthetically appealing.

According to one aspect of the present invention, a rail apparatus is configured to be mounted to a frame of a bed. The apparatus includes a siderail, a support having a first end pivotably coupled to the siderail and a second end, and a bottom mounting pivotably coupled to the second end of the support. The bottom mounting including at least one mounting bracket for coupling the bottom mounting to the frame of the bed, and an accessory rail configured to permit mounting of accessory items on the rail apparatus.

According to another aspect of the present invention, a rail apparatus is configured to be mounted to a frame of a bed. The apparatus includes an elongated mounting rail, at least one mounting bracket for coupling the mounting rail to the frame, and an accessory rail coupled to the mounting rail. The accessory rail is configured to receive accessory items. The apparatus also includes a siderail having a plurality of tubes and a top rail. Each tube has a first end coupled to the top rail and a second end coupled between the mounting rail and the accessory rail.

In the illustrated embodiment, the accessory rail has a length which is longer than a length of the top rail of the siderail so that accessory rail extends beyond the siderail to facilitate mounting of accessory items to the accessory rail. The accessory rail extends beyond at least a first end of the siderail. Also in the illustrated embodiment, the accessory rail extends along substantially a full length of a side of the bed. The accessory rail includes first and second ends which are curved inwardly toward the mounting rail. The first and second curved ends of the accessory rail are welded or otherwise fastened to the mounting rail in the illustrated embodiment.

The illustrated accessory rail has a rectangular cross sectional shape and is covered with a scratch resistant coating. A drain bag holder is coupled to the mounting bracket.

In the illustrated embodiment, the first end each tube is pivotably coupled to the top rail and the second end of each tube is pivotably coupled between the mounting rail and the accessory rail so that the siderail is pivotable between an upright barrier position and a collapsed storage position. The second end of each tube is coupled to a bushing. Each bushing is pivotably coupled between the mounting rail and the accessory rail by a fastener. A spacer block is coupled between the bushing and one of the mounting rail and the accessory rail by the fastener.

Additional objects, features, and advantages of the invention will become apparent to those skilled in the art upon consideration of the following detailed description of the preferred embodiment exemplifying the best mode of carrying out the invention as presently perceived.

DETAILED DESCRIPTION OF THE DRAWINGS

Figure 1:
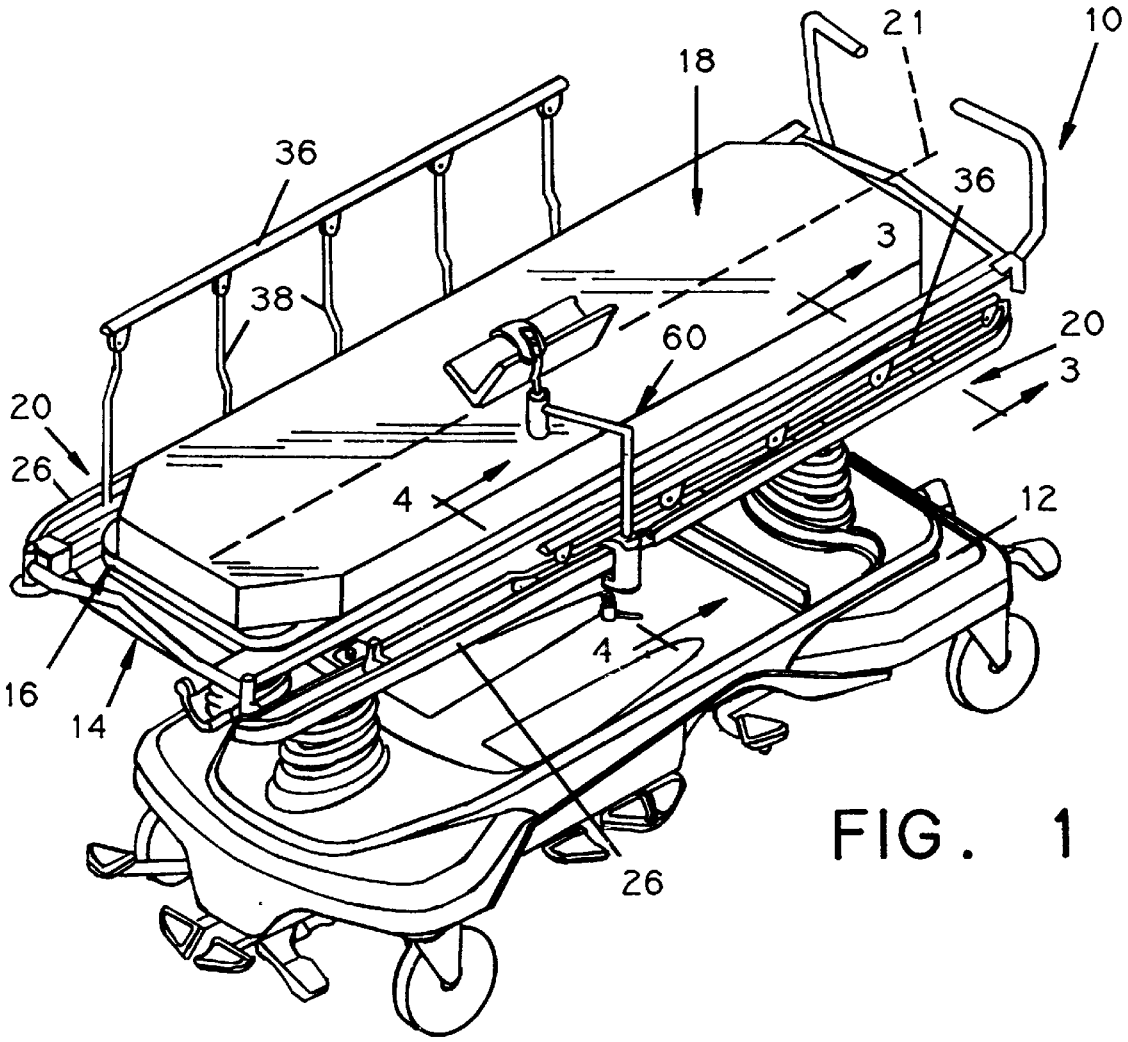
FIG. 1 is a perspective view illustrating an integrated siderail and accessory rail assembly mounted on each side of a stretcher or bed.

Referring now to the drawings, FIG. 1 illustrates a bed 10 having a base 12 and a frame 14 coupled to the base 12. A deck 16 is coupled to the frame 14, and a patient support surface 18 is located on the deck 16. Although a stretcher-type bed 10 is illustrated in FIG. 1, it is understood that any type of bed can be used in accordance with the present invention. The deck 16 may be an articulating deck which moves relative to the frame 14 in a conventional manner.

Figure 2:
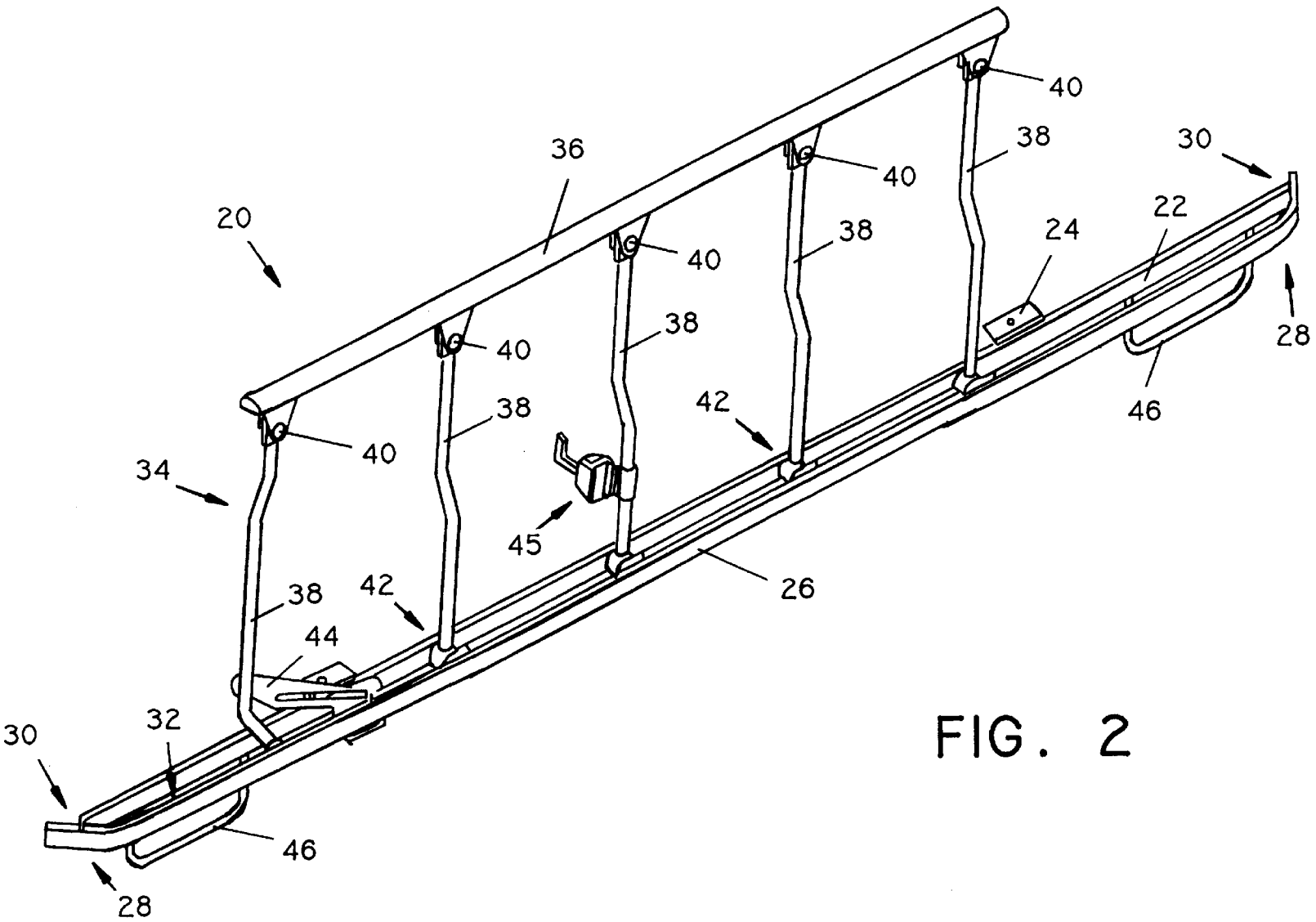
FIG. 2 is a perspective view illustrating details of the integrated siderail and accessory rail assembly of the present invention.

An integrated rail assembly 20 of the present invention is mounted to opposite sides of the bed 10 to extend parallel to a longitudinal axis 21 of the bed 10. The rail assembly 20 is best illustrated in FIG. 2. The rail assembly 20 includes a straight mounting rail 22 having a length substantially equal to a length of the bed 10. Spaced apart mounting brackets 24 are coupled to the mounting rail 22 for securing the rail assembly 20 to the bed 10 as discussed in detail below.

Rail assembly 20 further includes an outer accessory rail 26 for coupling various accessory items to the rail assembly 20 as discussed below. Illustratively, rails 22 and 26 are made from an extruded aluminum material. Preferably, accessory rail 26 has inwardly bent or curved end portions 28 which are welded to opposite ends of the mounting rail 22 at locations 30. Therefore, a space or gap 32 is provided between the mounting rail 22 and the accessory rail 26.

A siderail assembly 34 for the bed 10 is coupled between the mounting rail 22 and the accessory rail 26. Siderail assembly 34 includes a top rail 36 pivotably coupled to top ends of siderail tubes 38 by pivot connections 40. Opposite, bottom ends of the tubes 38 are pivotably coupled between the mounting rail 22 and the accessory rail 26 by lower pivot connections 42 as discussed below. A latch plate 44 is coupled between an end tube 38 and the mounting rail 22 and accessory rail 26 to hold the siderail assembly 34 in an upright position illustrated in FIG. 2. U-shaped drain bag holders 46 are coupled to opposite ends of mounting rail 22. A stop 45 is coupled to one tube 38 for engaging frame 14 when siderail 20 is in the upwardly pivoted in use position of FIG. 2.

Preferably, the entire rail assembly 20 is coated with a Nylon-based finish to provide a scratch resistant outer surface. After the mounting rail 22 and the accessory rail 26 are welded together, the rails 22 and 26 are preferably dipped into a bath to provide the Nylon based finish. It is understood that another type of scratch resistant surface can be used, if desired. The color of the finish can be selected to match the color of the base 12 of frame 14 of bed 10. In addition, the accessory rail may be formed from stainless steel, or made from an injection molded plastic material or other suitable material.

Figure 3:
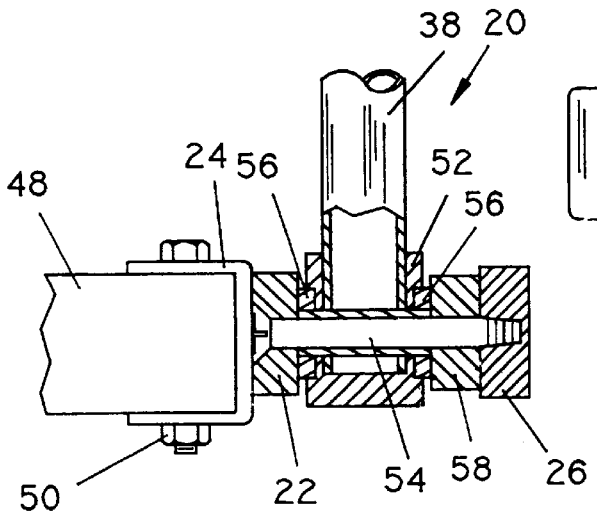
FIG. 3 is a sectional view taken along lines 3—3 of FIG. 1 illustrating mounting of the siderail and accessory rail assembly to a frame member of the bed.
Figure 4:
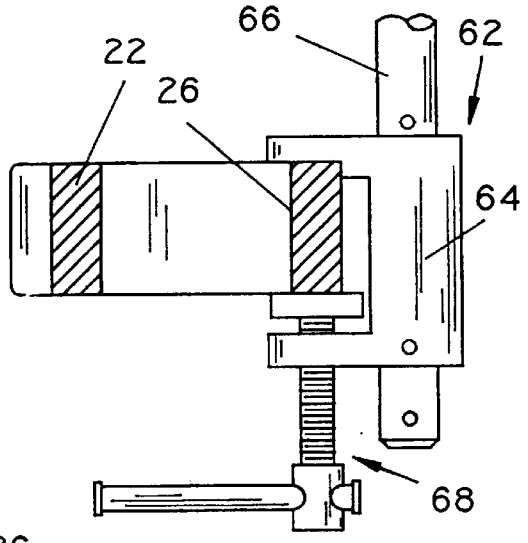
FIG. 4 is a sectional view taken along lines 4—4 of FIG. 1 illustrating connection of an accessory item to the accessory rail using a suitable clamp.

Details of the connection of the rail assembly 20 to the bed 10 are illustrated in FIG. 3. The mounting brackets 24 are illustratively U-shaped to fit over a frame member 48 of bed 10. Mounting brackets 24 are secured to frame member 48 by suitable fasteners 50. Frame member 48 may be a swing arm pivotably coupled to the bed 10, if desired. Other suitable fasteners such as a clamping device may be used instead of brackets 24.

Also as illustrated in FIG. 3, each tube 38 of siderail 34 extends into a rotatable bushing 52 which is connected between mounting rail 22 and accessory rail 26 by a suitable fastener 54. Wave washers 56 are located on opposite sides of bushing 52. A spacer block 58 is located between bushing 52 and accessory rail 26. Therefore, siderail 34 can pivot from an upwardly pivoted barrier position shown on one side of the bed 10 in FIG. 1 and in FIG. 2 to a downwardly pivoted, storage position shown an opposite side of the bed 10 in FIG. 1.

After the rail assembly 20 is coupled to the bed, the siderails 34 can function in a conventional manner. The accessory rail 26 permits accessory items such as item 60 in FIG. 1 to be mounted to the accessory rail 26. Illustratively, a clamp 62 is used to secure the accessory item 60 to the accessory rail 26. Clamp 62 includes a C-shaped body 64 for receiving a support post 66. A threaded actuator 68 is rotatable to secure the clamp 62 to the accessory rail 26. Illustratively, the accessory rail 26 may be a 10 mm×25 mm rail to accept standard European clamp sizes.

It is understood that any type of accessory item can be coupled to the accessory rail with a similar clamp. It is also understood that accessory items may include hooks or other means for coupling the items directly to the accessory rail 26 without the need for clamp 62.

Since accessory rail 26 is integral with siderail 34, the accessory rail 26 does not interfere with any moving components of the bed 10 or the siderail 34. The integral rail assembly 20 of the present invention therefore permits the accessory rail 26 to be used with a any length siderail 34. As shown in FIG. 1, the accessory rail 26 extends substantially the entire length of bed 10. Therefore, the accessory rail 26 provides a perimeter bumper for the sides of bed 10. In addition, the accessory rail 26 does not require any exposed screws or fasteners for mounting. This improves cleanability of the accessory rail 26.

It is further understood that other types of support mechanisms can be used for the siderail. In certain instances, other pivoting arrangements may be used to secure the siderail to a bottom mounting including the mounting rail 22 and accessory rail 26. See, for example, U.S. Pat. Nos. 2,722,017 or 5,129,117.

Although the invention has been described in detail with reference to a certain preferred embodiment, variations and modifications exist within the scope and spirit of the present invention as described and defined in the following claims.

What is claimed is:

1. A rail apparatus configured to be mounted to a frame of a bed as a unit, the apparatus comprising:

an elongated mounting rail;

at least one mounting bracket for coupling the mounting rail to the frame;

an accessory rail coupled to the mounting rail, the accessory rail being configured to receive accessory items;

a siderail including a plurality of tubes and a top rail, each tube having a first end pivotally coupled to the top rail and a second end pivotally coupled between and supported by the mounting rail and the accessory rail; and a spacer block between the pivotal coupling of the second end and the accessory rail of a sufficiently width to permit mounting of accessory items to the accessory rail adjacent the siderail without interfering with pivoting of the siderail.

2. The apparatus of claim 1, wherein the accessory rail has a length which is longer than a length of the top rail of the siderail so that accessory rail extends beyond the siderail to facilitate mounting of accessory items to the accessory rail.

3. The apparatus of claim 1, wherein the accessory rail extends beyond at least a first end of the siderail.

4. The apparatus of claim 1, wherein the accessory rail extends along substantially a full length of a side of the bed to provide a perimeter bumper for the bed.

5. The apparatus of claim 1, wherein the accessory rail includes first and second ends which are curved inwardly toward the mounting rail.

6. The apparatus of claim 5, wherein the first and second curved ends of the accessory rail are welded to the mounting rail.

7. The apparatus of claim 1, wherein the accessory rail has a rectangular cross sectional shape.

8. The apparatus of claim 1, wherein the accessory rail is covered with a scratch resistant coating.

9. The apparatus of claim 1, further comprising a drain bag holder coupled to the mounting bracket.

10. The apparatus of claim 1, wherein the second end of each tube is coupled to a bushing, each bushing being pivotably coupled between the mounting rail and the accessory rail by a fastener.

11. The apparatus of claim 10, the spacer block is coupled between the bushing and the accessory rail by the fastener.

12. A rail apparatus configured to be mounted to a frame of a bed as a unit, the apparatus comprising a siderail, a support having a first end pivotally coupled to the siderail and a second end, and a bottom mounting pivotally coupled to the second end of the support, the bottom mounting including at least one mounting bracket for coupling the bottom mounting to the frame of the bed, and an accessory rail configured and coupled to the bottom mounting and the second end of the support by a spacer of sufficient width to permit mounting of accessory items on the rail apparatus adjacent the siderail without interfering with pivoting of the siderail.

13. The apparatus of claim 12, wherein the support includes a plurality of tubes, each tube having a first end pivotably coupled to the siderail and a second end pivotably coupled to the bottom mounting so that the siderail is pivotable between an upright barrier position and a collapsed storage position.

14. The apparatus of claim 12, wherein the accessory rail has a length which is longer than a length of the siderail so that accessory rail extends beyond the siderail to facilitate mounting of accessory items to the accessory rail.

15. The apparatus of claim 12, wherein the accessory rail extends along substantially a full length of a side of the bed to provide a perimeter bumper for the bed.

16. The apparatus of claim 12, wherein the bottom mounting includes an elongated mounting rail and at least one mounting bracket for coupling the mounting rail to the frame of the bed, the accessory rail including first and second ends which are curved inwardly toward and coupled to the mounting rail.

17. The apparatus of claim 12, wherein the accessory rail has a rectangular cross sectional shape.

18. The apparatus of claim 12, wherein the accessory rail is covered with a scratch resistant coating.

19. The apparatus of claim 12, wherein the accessory rail extends beyond at least a first end of the siderail.

20. A rail apparatus configured to be mounted to a frame of a bed as a unit, the apparatus comprising:

an elongated mounting rail;

at least one mounting bracket for coupling the mounting rail to the frame;

an accessory rail coupled to the mounting rail and being configured to receive accessory items;

the accessory rail includes first and second ends which are curved inwardly toward the mounting rail and extends along substantially a full length of a side of the bed to provide a perimeter bumper for the bed; and a siderail pivotally coupled between and supported by the mounting rail and the accessory rail.

21. A rail apparatus configured to be mounted to a frame of a bed as a unit, the apparatus comprising:

an elongated mounting rail;

at least one mounting bracket for coupling the mounting rail to the frame;

an accessory rail coextensive with and coupled to the mounting rail at their respective ends and being configured to receive accessory items; and a siderail pivotally coupled between and supported by the mounting rail and the accessory rail.

* * * * *